US005213031A

United States Patent [19]

Hebbert

[11] Patent Number: 5,213,031

[45] Date of Patent: May 25, 1993

[54] CAN CRUSHER INCLUDING A RIPPER TOOTH

[75] Inventor: Timothy R. Hebbert, Casper, Wyo.

[73] Assignee: K N Energy, Inc., Lakewood, Colo.

[21] Appl. No.: 881,177

[22] Filed: May 11, 1992

[51] Int. Cl.[5] ..... B30B 9/32

[52] U.S. Cl. ..... 100/98 R; 100/215; 100/902; 222/87; 414/412

[58] Field of Search ..... 100/96–98 R, 100/131, 215, 902; 414/412; 222/87

[56] References Cited

U.S. PATENT DOCUMENTS

| | | | |
|---|---|---|---|
| 1,376,798 | 5/1921 | Courtney | 414/412 |
| 1,998,263 | 4/1935 | Townsend | 100/98 R X |
| 2,454,256 | 11/1948 | Myers | 100/98 R X |
| 2,496,606 | 2/1950 | Smith | 222/87 |
| 2,515,772 | 7/1950 | Hewlett | 100/97 |
| 2,616,477 | 11/1952 | Scheer et al. | 100/902 X |
| 2,763,202 | 9/1956 | Gramelspacher | 100/902 X |
| 3,412,675 | 11/1968 | Killough et al. | 100/902 X |
| 3,780,647 | 12/1973 | Reimers | 100/902 X |
| 3,889,587 | 6/1975 | Wharton | 100/98 R |
| 3,976,002 | 8/1976 | Gerlach | 100/215 |
| 4,126,160 | 11/1978 | Gurtler | 100/902 X |
| 4,345,518 | 8/1982 | Cash et al. | 100/98 R |
| 4,459,906 | 7/1984 | Cound et al. | 100/902 X |
| 4,469,212 | 9/1984 | DeWoolfson et al. | 100/902 X |
| 4,573,852 | 3/1986 | Rinfret et al. | 414/412 |
| 4,606,265 | 8/1986 | Meier | 100/902 X |
| 4,809,600 | 3/1989 | Yamamoto et al. | 100/902 X |
| 4,817,521 | 4/1989 | Katada et al. | 100/902 X |
| 4,859,132 | 8/1989 | Chasseray | 100/98 R X |
| 4,962,701 | 10/1990 | Stralow | 100/215 |

*Primary Examiner*—Stephen F. Gerrity
*Attorney, Agent, or Firm*—Fields, Lewis, Pittenger & Rost

[57] ABSTRACT

A can crusher for flattening cans is provided which has a cylindrical body having a first upstream end and a second downstream end. A fluid cylinder having a piston rod is connected to the first end of the body and a piston rod is mounted within the body and attached to the piston rod for movement from a retracted upstream position to an extended downstream position. A discharge opening is provided in the body adjacent the downstream end thereof. A can receiving opening is provided in the body spaced a distance from the discharge opening at least equal to the maximum can height to be accommodated by the can crusher. A ripper tooth extends longitudinally within the body from the can receiving opening to the discharge opening. A control device selectively supplies hydraulic fluid to opposite ends of the fluid cylinder to move the piston between the retracted position and the extended position to simultaneously drain liquid from the can as it is crushed. The piston has a longitudinal groove aligned with the ripper tooth through which the ripper tooth passes when the piston moves between the retracted position and the extended position.

20 Claims, 3 Drawing Sheets

CAN CRUSHER INCLUDING A RIPPER TOOTH

TECHNICAL FIELD

This invention relates to a hydraulic can crusher and more particularly to a can crusher for simultaneously draining residue liquid from the can as it is being crushed.

BACKGROUND ART

The collection storage and disposal of liquid and solid waste is a problem of ever increasing importance. The collection and storage of old paint cans is particularly troublesome. The cans themselves have considerable volume compared to the volume of the material of the can itself. Also, the cans often contain residue paint, oil or other liquid for which appropriate disposal is required. An important consideration in the disposal of cans containing paint or other liquid is how to rapidly empty the cans of their liquid content and collect it in one container while crushing the cans and placing them in a separate container. It is also desirable to empty the cans and crush them at a high rate of speed so that large numbers of them can be crushed within a given time period to make such efforts economically feasible.

The following examples of prior art in this field are suitable for their intended purpose, but none adequately address the above-mentioned problem of emptying the cans of their liquid residue and crushing them substantially simultaneously so that the residue liquid and the cans are placed in separate containers for subsequent disposal.

U.S. Pat. No. 4,345,518 to Cash et al. discloses a hand operated can crusher having a pair of pivotal arms, each with sharp point which are pivoted by movement of the piston so as to puncture the container prior to crushing. A hydraulically operated piston is disclosed in FIG. 4.

U.S. Pat. No. 3,976,002 to Gerlach discloses a can crusher having a piston which is pivotally pinned to a hydraulically cylinder and has a hopper for supplying multiple cans simultaneously into the compression chamber.

U.S. Pat. No. 4,962,701 to Stralow discloses a hand operated can crusher having a magazine or hopper for supplying the cans serially into the device.

U.S. Pat. No. 4,809,600 to Yamamoto et al. and U.S. Pat. No 4,817,521 to Katada et al. each disclose a can crushing device when the cans are compressed both axially and laterally by means of a grooved piston.

U.S. Pat. No. 4,126,160 to Gurtler discloses a can crushing and emptying device wherein one end of the can is cut-out to drain the contents, the can is flushed and then crushed by means of a ram.

U.S. Pat. No. 4,606,265 to Meier discloses a can crusher having a ratchet means for advancing the ram.

U.S. Pat. No. 4,469,212 to DeWoolfson et al. discloses a can crusher for aluminum cans which also dispenses money to those depositing cans in the apparatus.

DISCLOSURE OF THE INVENTION

In accordance with this invention, a can crusher for flattening cans is provided which has a cylindrical body having a first upstream end and a second downstream end. A fluid cylinder having a piston rod is connected to the first end of the body and a piston rod is mounted within the body and attached to the piston rod for movement from a retracted upstream position to an extended downstream position. A discharge opening is provided in the body adjacent the downstream end thereof. A can receiving opening is provided in the body spaced a distance from the discharge opening at least equal to the maximum can height to be accommodated by the can crusher. A ripper tooth extends longitudinally within the body from the can receiving opening to the discharge opening. Control means selectively supplies hydraulic fluid to opposite ends of the fluid cylinder to move the piston between the retracted position and the extended position. The piston has a longitudinal groove aligned with the ripper tooth through which the ripper tooth passes when the piston moves between the retracted position and the extended position.

More specifically, the groove in the piston can be formed as a longitudinal slot cut in the side wall of the piston so that the edges along the slot are spaced from each other a distance slightly greater than the width of the ripper tooth. An angle having opposite ends can have one of the ends attached to the inside of the side wall adjacent one edge of the slot and the other end attached to the inside of the side wall adjacent the other edge of the slot to maintain the spacing of these edges. A face plate can be provided on the distal end of the piston having a diameter slightly greater than that of the piston and an arcuate ring segment can be provided on the piston wall spaced from the face plate to serve as a piston ring to guide the piston within the cylindrical body. The piston is conveniently pivoted to the piston rod. This pivotal connection can be formed as a pair of opposed tubular sleeves extended inwardly from opposite sides of the piston wall. A piston pin extends through the sleeves and a yoke on the distal end of the piston rod is pivotally mounted on the pivot pin. Conveniently, gussets can extend between the piston wall and each of the sleeves for added strength. Means, such as a set screws can be provided for holding each of the pivot pins in fixed relationship.

A bearing plate is mounted at the downstream end of the cylindrical body to provide a reactive surface against which the piston crushes the can as the piston moves from the retracted position to the extended position. The bearing plate can be removably mounted against a plurality of substantially parallel rods extending transversely through the cylindrical body. The bearing plate is clamped against these rods by means of a plurality of bolts extending between the rods and through a transverse plate against the side of the rods opposite the bearing plate so that the bearing plate can be drawn tightly against the rods.

The fluid cylinder is pivotally attached to the cylindrical body adjacent the upstream end and the cylindrical body and has an access opening adjacent the fluid cylinder through which the cylinder can be serviced.

BEST MODE FOR CARRYING OUT THE INVENTION

Figure 1:
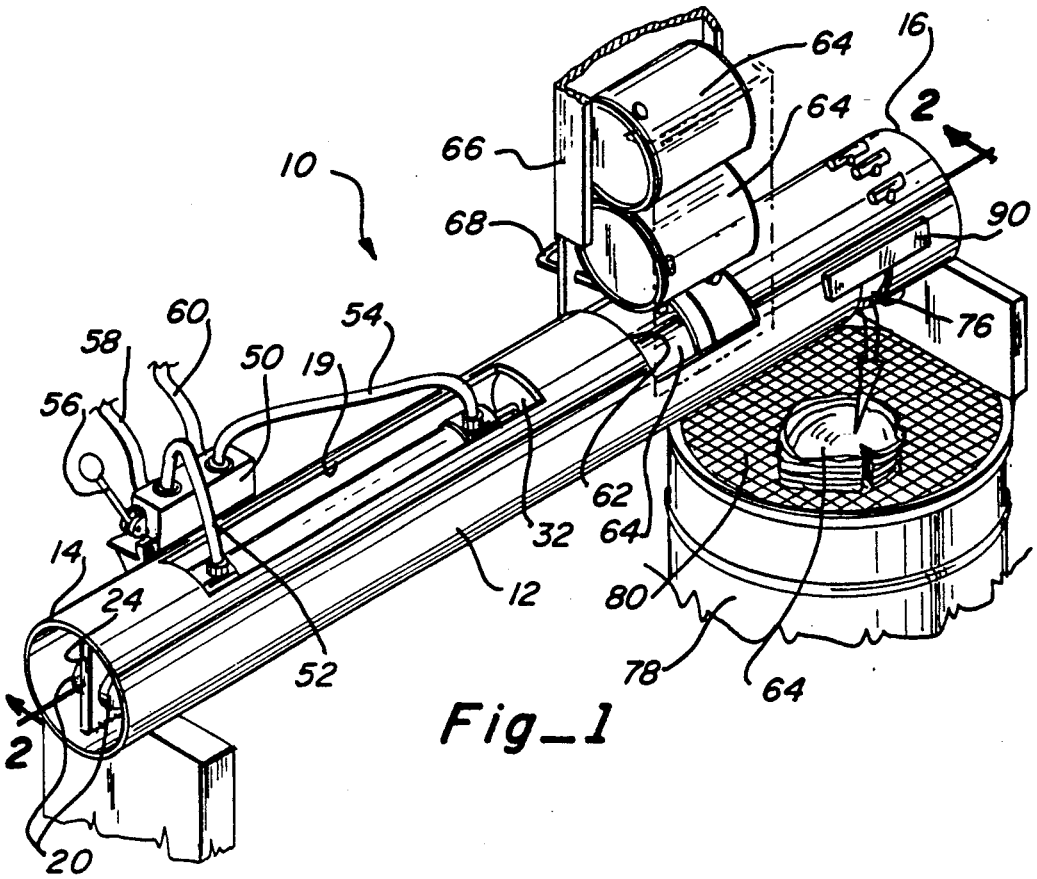
FIG. 1 is a perspective view of a can crusher constructed in accordance with this invention.

In accordance with this invention, a can crusher 10 is provided which has a long cylindrical body 12 having an upstream end 14 and a downstream end 16. A hydraulic cylinder 18 is mounted in cylindrical body 12 adjacent upstream end 14, as shown. Conveniently, an access opening 19 is provided in the side of cylindrical body 12 for servicing cylinder 18. The cylinder includes a pair of spaced ears 20, each having an opening 21 through which a pivot pin 22 extends for connecting them to a vertical plate 24, having a central opening 25, fixedly attached within cylinder 12, as by welding. A piston rod 26 extends from the downstream end of cylinder 18. A clevis 28 is attached to the distal end of piston rod 26 for connecting it to a pivot pin 30 extending through a pair of opposed ears 31 formed at the upstream end of piston 32.

Piston 32 has a cylindrical wall 34 which has a crusher face in the form of plate 36 attached to the downstream end thereof, as by welding. A longitudinal slit or groove 38 is formed in the bottom of wall 34 for receiving a ripper tooth, as further explained below. The edges of slot 38 are held in fixed position by angle member 40 whose side edges are welded to the inside of on opposite sides of groove 38 to maintain the spacing of the edges of the groove. Conveniently, pivot pin 30 is mounted in a pair of sleeves 42, each projecting inwardly toward each other from opposite ears 31 of piston 32. The pivot pin is held in place by a pair of set screws 44, respectively. For added strength, a pair of gussets 46 extend from the sleeves 42 to the inside of the wall 34, as shown. A ring 48 may be made as a weld if desired to serve as a piston ring to keep the piston aligned within cylinder 12 as it is reciprocated by cylinder 18.

A conventional hydraulic control 50 is connected to opposite ends of the cylinder by fluid conduits 52 and 54 for supplying fluid to opposite ends of the cylinder. The control can be operated by control lever 56. The control 50 is provided with a fluid inlet hose 58 and a fluid outlet hose 60 for supplying hydraulic fluid from a source (not shown).

Downstream from hydraulic cylinder 18 is a can access opening 62 having a length equal to the height of the largest can to be inserted into the can crusher. The cans 64 are supplied through access opening 62 for positioning within cylindrical body 12 so that they rest in alignment with piston 32 when it is in a retracted position shown in FIG. 2. The inside diameter of cylindrical body 12 is greater than the outside diameter of the largest can to be crushed so that the can is completely encircled by the cylindrical body 12. The cans 64 can be supplied to access opening 62 by means of an optional magazine 66 which can store a supply of cans and guide them through the access opening as each successive can is being crushed. Conveniently, the magazine includes a moveable cross member 68 for supporting the supply of cans while the can to be crushed is in can crusher 10.

Figure 2:
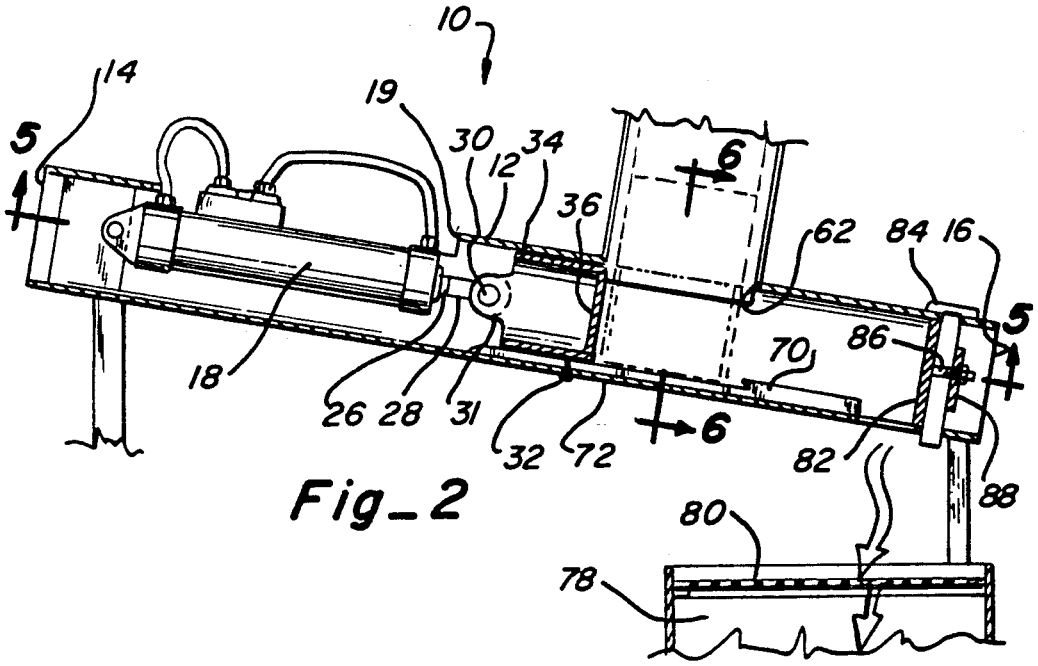
FIG. 2 is a longitudinal section, taken along line 2—2 of FIG. 1, showing the internal mechanism of the can crusher with the piston in retracted position.
Figure 3:
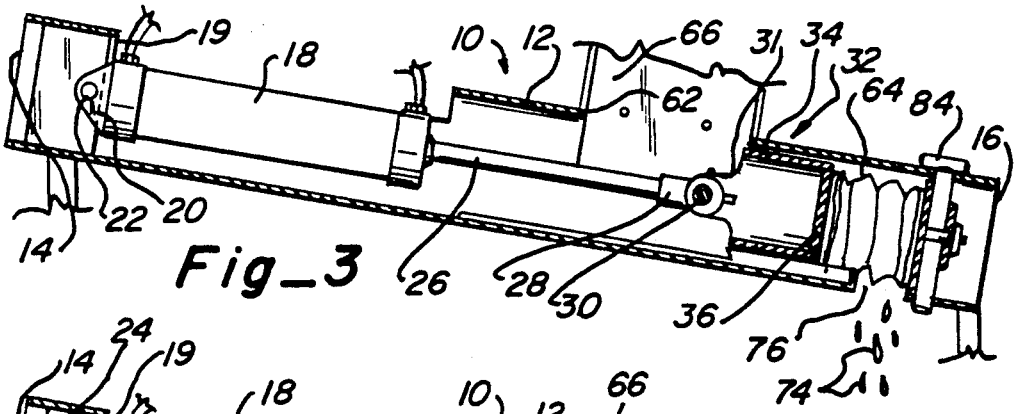
FIG. 3 is a longitudinal section, similar to FIG. 2, but showing the piston partially extended to begin the can crushing movement.
Figure 4:
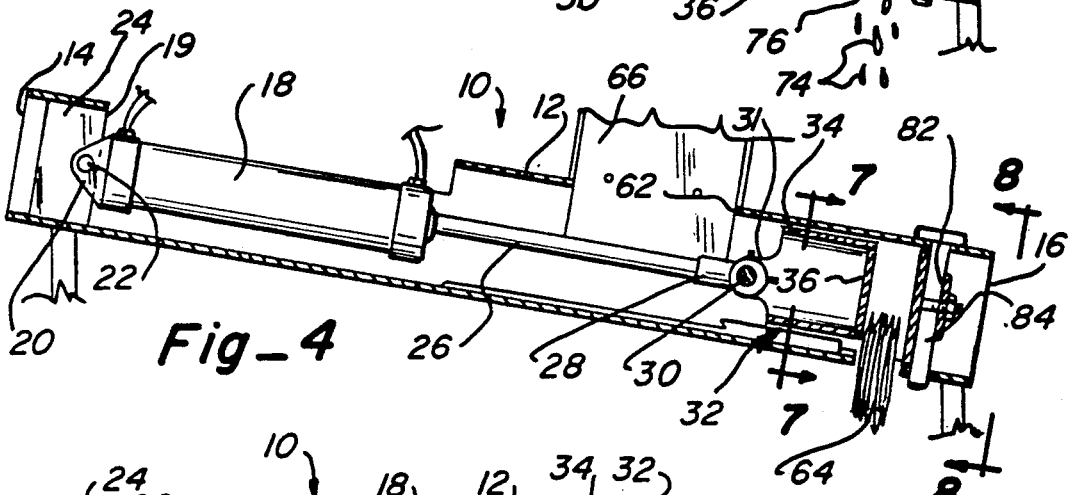
FIG. 4 is a longitudinal section, similar to FIGS. 2 and 3, but showing the cylinder substantially fully extended and the can completely crushed.
Figure 5:
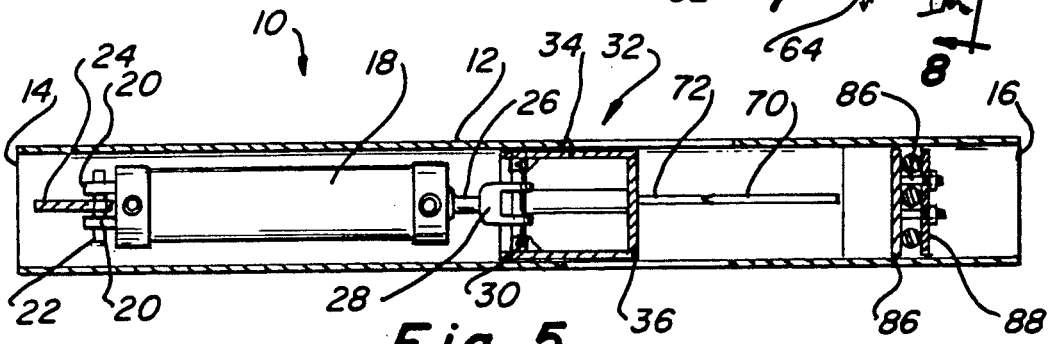
FIG. 5 is a horizontal section, taken along line 5—5 of FIG. 2, showing additional details of the can crusher.
Figure 6:
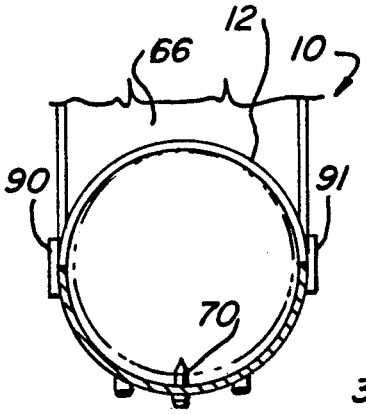
FIG. 6 is an enlarged vertical section, taken along line 6—6 of FIG. 2, showing the can receiving opening and the ripper tooth construction.
Figure 7:
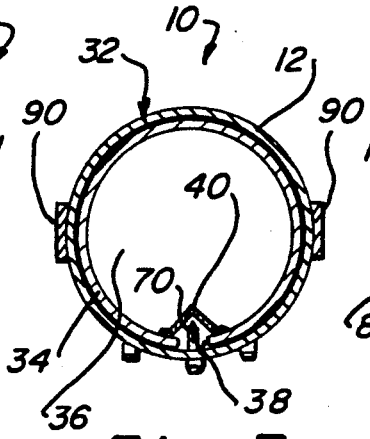
FIG. 7 is an enlarged vertical section, taken along line 7—7 of FIG. 4, showing details of the groove formed in the piston wall for accommodating the ripper tooth.
Figure 8:
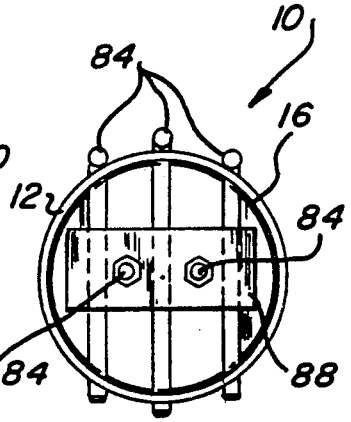
FIG. 8 is an enlarged end view of the downstream end of the can crusher looking along line 8—8 of FIG. 4.
Figure 9:
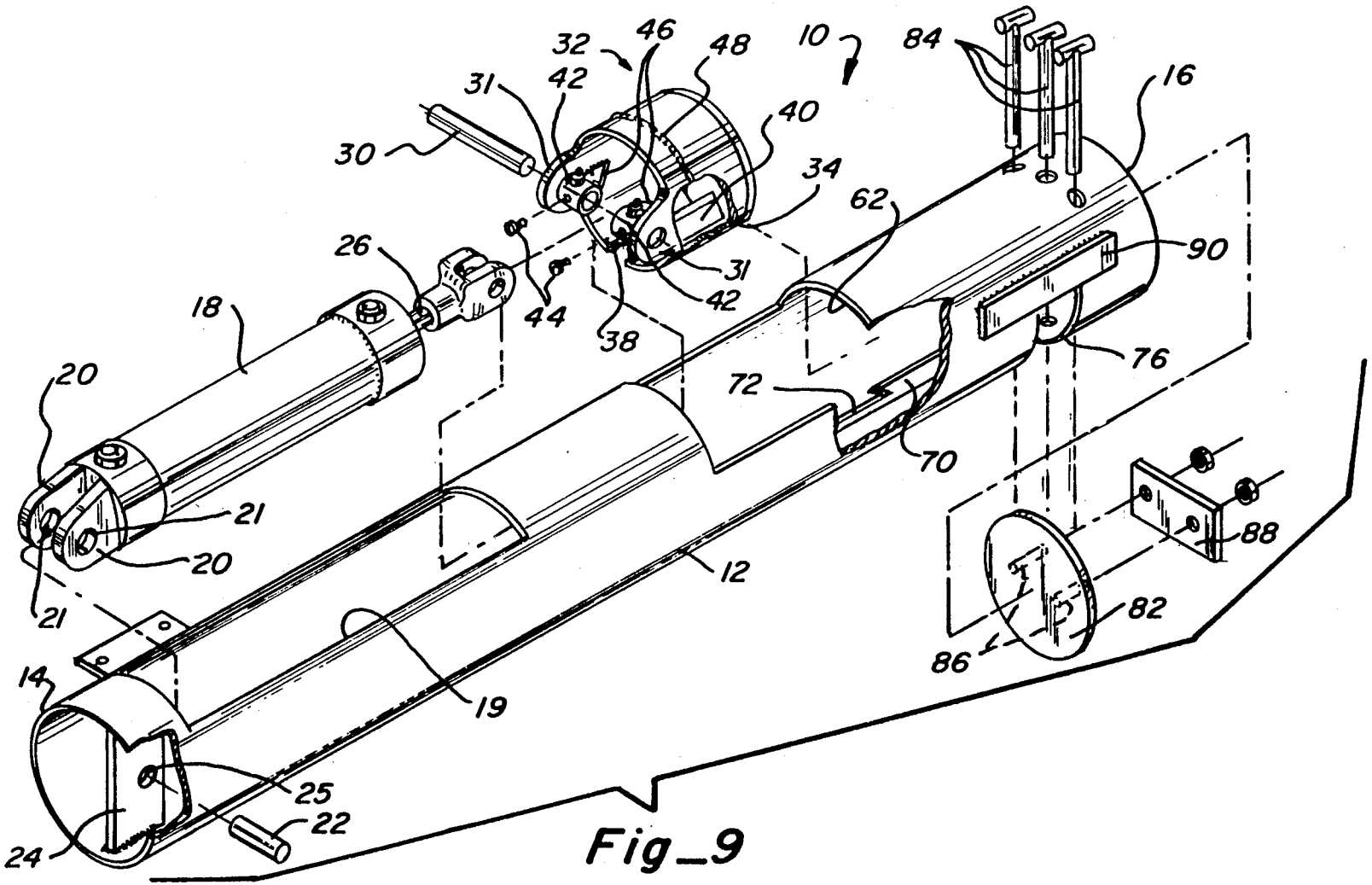
FIG. 9 is an exploded perspective view of the can crusher.

A ripper tooth 70 is positioned along the bottom of cylinder 12 and downstream of access opening 62. It is formed integrally with a guide bar 72 that extends upstream from ripper tooth 70 past access opening 62 and just beyond the position of piston 32 when in its retracted position, as shown in FIG. 2. Conveniently, the ripper tooth and guide bar are received in groove 38 formed in wall 34 of piston 32 so that the piston can freely move from its retracted position shown in FIG. 2 to its extended position shown in FIG. 4. During this movement, a can in the can crusher will engage the sharp upstream edge of ripper tooth 70 thereby puncturing the can to allow any liquid, such as liquid 74, shown in FIG. 3, to flow through discharge opening 76, formed in the bottom of body 12, into a reciprocal, such as barrel 78. As the piston moves toward its extended position, the can is crushed as shown in FIG. 3 to its final crushed size, as shown in FIG. 4. The hydraulic cylinder is then reversed so that the piston 32 moves away from the crushed can allowing it to pass through discharge opening 76 where it will be caught on a grate 80 provided across the top of barrel 78. The crushed cans can then be removed from the grate and placed in a separate storage container. This can be done manually or by automatic means (not shown) which can be provided for this purpose.

During the crushing operation, the can is pressed against a removable bearing plate 82 which is positioned just downstream of discharge opening 76 and upstream from the downstream end 16 of cylindrical body 12. The bearing plate is held in position by a plurality of vertical rods or pins 84 which drop through openings in the top of body 12. The bearing plate 82 is held against rods 84 by means of threaded bolts 86 which are tightened against a backing plate 88, as shown.

Reinforcing bars 90 are provided on opposite sides of body 12 and extend across discharge opening 76 to provide reinforcing so that the pressure of piston 32 against bearing plate 82 will not cause any flexing or bending of the downstream end 16 of body 12.

From the foregoing, the advantages of this invention are readily apparent. A can crusher has been provided which is economical and simple in construction yet has the ability to puncture the can and drain the contents therefrom as the can is being crushed. The liquid discharged from the can after it has been punctured can be collected in one container and the crushed cans can be collected in another container.

This invention has been described in detail with reference to a particular embodiment thereof, but it will be understood that various other modifications can be effected within the spirit and scope of this invention.

What is claimed is:

1. A can crusher for flattening cans for disposal and/or recycling, said can crusher comprising:

a cylindrical body having a first upstream end and a second downstream end said second end including a reactive surface;

a hydraulic fluid cylinder mounted in said body and connected to said first end thereof and having a piston rod mounted for reciprocal movement therein between a retracted position and an extended position;

a discharge opening in said body adjacent said second end thereof;

a can receiving opening in said body longitudinally spaced from said discharge opening to thereby define between said can receiving opening and said discharge opening a longitudinally extending and circumferentially solid region of said body having a length at least equal to a can height to be accommodated by said can crusher;

a piston having a cylindrical side wall having an inside and an outside, mounted within said body and attached to said piston rod for movement from a retracted position upstream of said can receiving opening to an extended downstream position at said discharge opening to flatten the can between said piston and said reactive surface, said piston having a proximal end and a distal end;

a ripper tooth, having a width, extending longitudinally within said longitudinally extending and circumferentially solid region of said body at least from said can receiving opening to said discharge opening for ripping a can as the can is moved by said piston from said can receiving opening toward said discharge opening; and control means selectively supplying hydraulic fluid to opposite ends of said hydraulic fluid cylinder to move said piston rod and thereby move said piston between said retracted position and said extended position.

2. Apparatus, as claimed in claim 1, wherein:

said piston has a longitudinal groove aligned with said ripper tooth through which said riper tooth passes when said piston moves between said retracted position and said extended position.

3. Apparatus, as claimed in claim 2, wherein:

said groove is formed as a longitudinal slot cut in said side wall of said piston having side edges along said slot spaced from each other a distance slightly greater than the width of said ripper tooth; and an angle member extending longitudinally within said piston wall and having opposite side edges, one of said side edges being attached to said inside of said side wall adjacent one edge of said slot and the other side edge of said angle member being attached to said inside of said side wall adjacent said other edge of said slot to maintain the spacing of said slot edges.

4. Apparatus, as claimed in claim 1, wherein said piston further includes:

a face plate on said distal end of said piston and having a diameter slightly larger than that of said piston wall;

a pivotal connection at said proximal end of said piston connecting said piston to said piston rod; and an arcuate ring segment on said piston wall adjacent said pivotal connection serving as a piston ring to guide said piston within said cylindrical body.

5. Apparatus, as claimed in claim 4, wherein:

said arcuate ring segment is made as a weld.

6. Apparatus, as claimed in claim 4, wherein said piston wall has opposed ears formed at the proximal end thereof and said pivotal connection comprises:

a pair of opposed tubular sleeves extending inwardly from opposite ears of said piston wall;

a pivot pin extending through said sleeve; and a yoke on the distal end of said piston rod pivotally mounted on said pivot pin.

7. Apparatus, as claimed in claim 6, further comprising:

a gusset extending between each said ear and each of said sleeves.

8. Apparatus, as claimed in claim 6, further including:

means in each of said sleeves for holding said pivot pin in fixed relationship thereto.

9. Apparatus, as claimed in claim 1, further including:

a bearing plate mounted at said downstream end of said cylindrical body to provide said reactive surface against which said piston crushes the can as said piston moves from said retracted position to said extended position.

10. Apparatus, as claimed in claim 9, further includes:

means removably supporting said bearing plate at said downstream end of said cylindrical body.

11. Apparatus, as claimed in claim 10, wherein said supporting means comprises:

a plurality of substantially parallel rods extending transversely through said cylindrical body; and clamping means holding said bearing plate against one side of said rods.

12. Apparatus, as claimed in claim 11, wherein said clamping means comprises:

a transverse plate on the side of said rods opposite said bearing plates; and a plurality of threaded bolts extending between said rods and through said bearing plate and said transverse plate for drawing them tightly against said rods.

13. Apparatus, as claimed in claim 1, wherein: said fluid cylinder is pivotally attached to said cylindrical body adjacent said upstream end thereof.

14. Apparatus, as claimed in claim 1, wherein:

said cylindrical body has an access opening adjacent said fluid cylinder through which said cylinder can be serviced.

15. Apparatus, as claimed in claim 1, further including:

magazine connected to said cylindrical body for holding a plurality of cans for successively supplying them to the can crusher through the can receiving opening.

16. A can crusher for flattening cans for disposal and/or recycling, said can crusher comprising a cylindrical body having a first upstream end and a second downstream end, said second end including a reactive surface;

a hydraulic fluid cylinder mounted in said body an connected to said first end thereof and having a piston rod mounted for reciprocal movement therein between a retracted position and an extended position;

a longitudinally extending access opening adjacent said fluid cylinder through which said fluid cylinder can be serviced;

a discharge opening in said body adjacent said second end thereof;

a can receiving opening in said body on the opposite side from said discharge opening and longitudinally spaced from said discharge opening to thereby define between said can receiving opening and said discharge opening a longitudinally extending and circumferentially solid region of said body having a length at least equal to a can height to be accommodated by said can crusher;

a piston with a proximal end and a distal end, having a cylindrical side wall with an inside and an outside and a crusher face on the distal end thereof, and said piston mounted within said body and attached to said piston rod for movement from a retracted position upstream of said can receiving opening to an extended downstream position at said discharge opening to flatten a can between said crusher face and said reactive surface;

pivot means attaching said proximal end of said piston to said piston rod;

a longitudinal groove in said piston aligned with said ripper tooth through which said ripper tooth passes when said piston moves between said retracted position and said extended position;

a baring plate mounted at said downstream end of said cylindrical body to provide said reactive surface against which said piston crushes the can; and a control means selectively supplying hydraulic fluid to opposite ends of said hydraulic fluid cylinder to move said piston rod and thereby move said piston between said retracted position and said extended position.

17. Apparatus, as claimed in claim 16, wherein:

said groove is formed as a longitudinal slot cut in said side wall of said piston having side edges along said slot spaced from each other a distance slightly greater than the width of said ripper tooth; and an angle member extending longitudinally within said piston wall and having opposite side edges, one of said side edges being attached to said inside of said side wall adjacent one edge of said slot and the other side edge of said angle member being attached to said inside of said side wall adjacent said other edge of said slot to maintain the spacing of said slot edges.

18. Apparatus, as claimed in claim 16, further including:

a pivotal attachment connecting the upstream end of said hydraulic fluid cylinder to said upstream end of said cylindrical body.

19. Apparatus, as claimed in claim 18, wherein said pivotal attachment includes:

a pair of ears extending upstream from said hydraulic fluid cylinder, each of said ears having a circular opening therethrough;

a vertical plate attached to said cylindrical body adjacent said upstream end thereof and having a central circular opening; and a pivot pin extending through said openings so that said upstream end of said hydraulic cylinder pivots about said plate.

20. Apparatus, as claimed in claim 16, further including:

a magazine connected to cylindrical body for holding a plurality of cans for successively supplying them to the can crusher through the can receiving opening.

* * * * *

UNITED STATES PATENT AND TRADEMARK OFFICE

CERTIFICATE OF CORRECTION

PATENT NO. : 5,213,031

DATED : May 25, 1993

INVENTOR(S) : Timothy R. Hebbert

It is certified that error appears in the above-identified patent and that said Letters Patent is hereby corrected as shown below:

Column 6, Line 42, before "magazine" insert --a--;
Line 51, delete "an" and insert --and--.

Column 7, between Lines 9 and 10 insert --a ripper tooth, having a width, extending longitudinally within said longitudinally extending and circumferentially solid region of said body at least from said can receiving opening to said discharge opening for ripping a can as the can is moved by said piston from said can receiving opening toward said discharge opening;--.

Signed and Sealed this

Twenty-ninth Day of March, 1994

Bruce Lehman

*Attest:*

BRUCE LEHMAN

*Attesting Officer*

*Commissioner of Patents and Trademarks*